US009402462B1

(12) United States Patent
Alinsli et al.

(10) Patent No.: US 9,402,462 B1
(45) Date of Patent: Aug. 2, 2016

(54) ORAL-CARE IMPLEMENT HAVING SPRING-LOADED CLEANING ELEMENTS

(71) Applicant: Braun GmbH, Kronberg (DE)

(72) Inventors: Jens Alinsli, Kelkheim (DE); Robert Schütz, Wiesbaden (DE); Karen Lynn Claire-Zimmet, Kronberg (DE)

(73) Assignee: BRAUN GMBH, Kronberg (DE)

( * ) Notice: Subject to any disclaimer, the term of this patent is extended or adjusted under 35 U.S.C. 154(b) by 0 days.

(21) Appl. No.: 14/704,191

(22) Filed: May 5, 2015

(51) Int. Cl.
*A46B 9/02* (2006.01)
*A46B 9/04* (2006.01)
*A46B 9/10* (2006.01)

(52) U.S. Cl.
CPC . *A46B 9/04* (2013.01); *A46B 9/025* (2013.01); *A46B 9/10* (2013.01)

(58) Field of Classification Search
CPC ..... A46B 9/025; A46B 9/04; A46B 9/10
See application file for complete search history.

(56) References Cited

U.S. PATENT DOCUMENTS 2,864,111 A * 12/1958 Rotceig ..... A46B 7/02 15/167.1
3,314,096 A * 4/1967 Berliner ..... A46B 7/04 132/107
5,881,426 A * 3/1999 Tong ..... A46B 9/023 15/167.1
5,987,688 A 11/1999 Roberts et al.
6,151,745 A 11/2000 Roberts et al.
6,553,604 B1 4/2003 Braun et al.
7,975,344 B2 * 7/2011 Braun ..... A46B 3/16 15/110
8,239,995 B2 8/2012 Chenvainu et al.
8,516,645 B2 * 8/2013 Kraemer ..... A46B 5/0029 15/201
2002/0138926 A1 10/2002 Brown et al.
2004/0128784 A1 * 7/2004 Ben-Ari ..... A46B 7/06 15/167.1
2004/0177462 A1 9/2004 Brown et al.
2005/0235439 A1 10/2005 Braun et al.
2006/0213018 A1 * 9/2006 Gross ..... A46B 5/02 15/143.1

* cited by examiner

*Primary Examiner* — Randall Chin
(74) *Attorney, Agent, or Firm* — Vladimir Vitenberg

(57) ABSTRACT

An oral-care implement having a longitudinal axis, a bristle carrier, and a plurality of cleaning including a spring-loaded cleaning element movably disposed in a channel formed in the bristle carrier and comprising a spring portion disposed in the channel and a projecting portion longitudinally adjacent to the spring portion and outwardly extending from the channel at an angle of projection relative to the longitudinal axis. The spring portion can elastically deform inside the channel to conform to the channel's shape, thereby causing the projecting portion to change its length and angle of projection.

17 Claims, 6 Drawing Sheets

ORAL-CARE IMPLEMENT HAVING SPRING-LOADED CLEANING ELEMENTS

FIELD OF THE INVENTION

The present disclosure is directed to an oral-care implement, such as a toothbrush, having a plurality of cleaning elements that are spring-loaded inside the toothbrush's body.

BACKGROUND OF THE INVENTION

Recent advancements in oral-care implements include toothbrushes having angled, multi-level, and pivoting cleaning elements, such as bristles and tufts. For example, a commonly assigned U.S. Pat. No. 8,239,995 is directed to an oral-hygiene device that includes a head having a fixed component and a movable component, the latter being movable between a first configuration and a second configuration. A first bristle field extends from the fixed component, and a second bristle field extends from the movable component. The first bristle field and second bristle field are controllably movable between a first configuration for providing a first cleaning operation and a second configuration for providing a second cleaning operation.

A commonly assigned US Patent Application Serial No. 2002/0138926 A1 is directed to a head for an electric toothbrush including a support member having a plurality of holes, through which a plurality of bristle tufts extend. The tufts are prevented from being withdrawn from the holes when a tensile force is applied to the tufts' first ends along the tufts' longitudinal axes. A resilient cushion is positioned adjacent to a second side of the support member such that the tufts' second ends can contact the cushion. When a compressive force is applied to the first ends of the tufts, along the long axis of each tuft, each tuft can move in its hole in a first direction into the cushion. When the compressive force is removed the cushion causes each tuft to move in its hole in a second direction substantially opposite to the first direction. Such action assists in preventing potential damage to a user's gums when excessive pressure is used during brushing of the teeth.

In addition to providing a cushioned mechanism to avoid a possible excessive force during brushing, one could benefit from causing the bristle tufts to move, under brushing pressure, in a desired manner, including a pattern or patterns of the bristles' deflection and their angled orientation.

SUMMARY OF THE INVENTION

An oral-care implement comprises a bristle carrier and a plurality of cleaning elements embedded in and outwardly extending from the bristle-carrier. The cleaning elements can extend from the bristle carrier at different angles.

At least one of the plurality of cleaning elements is a spring-loaded cleaning element movably disposed in a channel formed in the bristle carrier. The spring-loaded cleaning element comprises a spring portion disposed in the channel and a projecting portion longitudinally adjacent to the spring portion. The projecting portion outwardly extends from the channel at an angle of projection relative to the longitudinal axis.

The spring portion is structured and configured to elastically deform inside the channel to at least partially conform to a shape of the channel. This causes the projecting portion to change its length and the angle of projection. The elastic deformation of the spring portion inside the channel can be designed to progress in accordance with a predetermined pattern based, at least partially, on the shape of the channel.

The channel comprises a curved portion structured and configured to facilitate the elastic deformation of the spring portion of the spring-loaded cleaning element inside the channel. In one embodiment, the channel includes a closed end and an open mouth opposite to the closed end, wherein the closed end supports an embedded end of the spring portion disposed in the channel, and the open mouth facilitates a movement of the spring-loaded cleaning element therethrough when the spring portion elastically deforms inside the channel. The movement of the spring-loaded cleaning element through the open mouth of the channel may include a change of the angle of projection of the projecting portion of the spring-loaded cleaning element.

In one embodiment, the oral-care implement comprises a shaft connected to the spring-loaded cleaning element. The shaft can be structured and configured to travel inside a channel along a travel path.

In one embodiment, an oral-care implement comprises a plurality of spring-loaded cleaning elements embedded in and outwardly extending from the bristle-carrier. Each of the spring-loaded cleaning elements is disposed in its respective channel formed in the bristle carrier and outwardly extends from the channel through an open mouth thereof. Each of the spring-loaded cleaning elements can be structured and configured to elastically deform inside the channel, wherein angles of projection at which individual spring-loaded cleaning elements outwardly extend from the bristle carrier change as the spring-loaded cleaning elements elastically deform inside their respective channels.

In a further embodiment, at least some of the angles of projection at which the individual spring-loaded cleaning elements outwardly extend from the bristle carrier differ from one another. In another embodiment, the angles of projection at which the individual spring-loaded cleaning elements outwardly extend from the bristle carrier may change non-uniformly relative to one another.

In one embodiment, each of the spring-loaded cleaning elements comprises a spring portion and a projecting portion longitudinally adjacent to the spring portion, wherein the spring portion is disposed in the channel and the projecting portion outwardly extends from said channel through an open mouth of the channel. The spring portion terminates with an embedded end thereof disposed in the channel. The projecting portion terminates with a free end. The spring portion is structured to elastically deform inside the channel when the oral-care implement is in use. This elastic deformation causes the second portion to change its length and the angle of projection.

In one embodiment, each of the channels includes a travel path disposed therein to receive a shaft for movement along the travel path. The shaft can be connected to the spring-loaded cleaning element, i.e., intermediate its embedded end and its free end. In use, a movement of the shaft along the travel path facilitates elastic deformation of the spring-loaded cleaning element inside the channel according to a predetermined pattern.

In a further embodiment, the oral-care implement may comprise channels having differential shapes—to cause differential elastic deformation of the spring-loaded cleaning elements. For example, the oral-care implement may comprise at least a first channel and a second channel, the first channel having a first spring-loaded cleaning element therein and the second channel having a second spring-loaded cleaning element therein, wherein a shape of the first channel is different from a shape of the second channel. In such an embodiment, the first channel can be configured to facilitate a first elastic deformation of the first spring-loaded cleaning element, and the second channel can be configured to facilitate a second elastic deformation of the second spring-loaded cleaning element, the first elastic deformation being different from the second elastic deformation. This results in the change of the angle of projection of the first spring-loaded cleaning element being different from the change of the angle of projection of the second spring-loaded cleaning element.

In a further embodiment, the first spring-loaded cleaning element may differ from the second spring-loaded cleaning element in at least one physical characteristic selected from the group consisting of length, thickness, geometry including, e.g., cross-sectional shape and area moment of inertia, stiffness, elasticity, surface energy, chemical composition, color, and any combination thereof.

DETAILED DESCRIPTION

The following text sets forth a broad description of numerous different embodiments of the present disclosure. The description is to be construed as exemplary only; it does not purport to describe every possible embodiment or variation of the invention since describing every possible embodiment or variation would be impractical, if not impossible. It should be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims.

Figure 1:
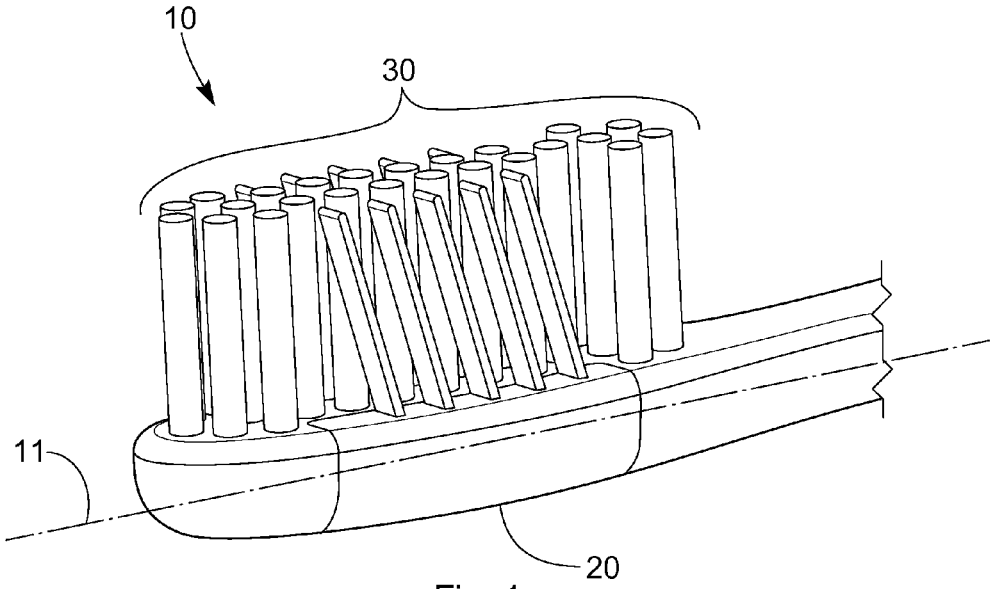
FIG. 1 schematically shows a perspective view of an embodiment of the oral-care implement having spring-loaded cleaning elements.

As is shown in FIG. 1, an oral-care implement 10 has a longitudinal axis 11 and comprises a bristle carrier 20 and a plurality of cleaning elements 30 embedded in and outwardly extending from the bristle-carrier 20. The plurality of cleaning elements may comprise conventional (stationary) cleaning elements, such as, e.g., those comprising PA6.12 (Nylon) or PBT or elastomeric cleaning elements. Exemplary embodiments having stationary cleaning elements 30*a* are shown in FIGS. 4A and 6A-6E. Several types of cleaning elements, e.g., are distributed by DuPont™ Corporation, such as, e.g., those under the brand name Tynex®; and by Hahl Pedex, GMBH. Non-limiting examples of suitable filaments include mixed filaments, coextruded filaments, core-and-sheath filaments, spiral filaments, surface-textured filaments, chemically tapered filaments, crimped filaments, foamed filaments, and others. A typical filament diameter may be from 4 mil to 8 mil.

Figure 2:
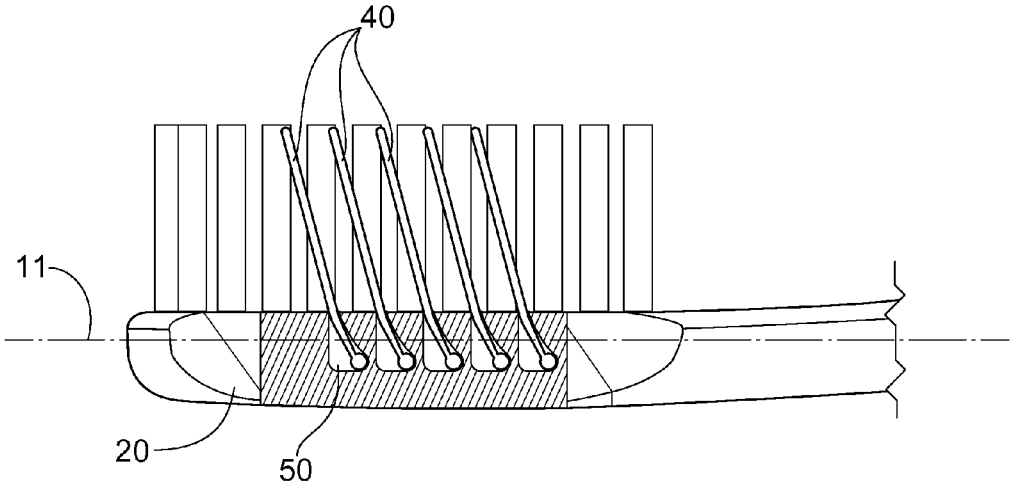
FIG. 2 schematically shows a cross-sectional view of the oral-care implement having spring-loaded cleaning elements.

At least one of the cleaning elements 30 is a spring-loaded cleaning element 40 movably disposed in a channel 50 formed in the bristle carrier 20, FIG. 2. The cleaning elements 30, including the spring-loaded cleaning elements 40, may extend from the bristle carrier at various differential angles, which may differ from one another. That is, a plurality of spring-loaded cleaning elements 40 may extend at an angle different from those of the non-spring-loaded cleaning elements. Further, the individual cleaning elements 30, including the spring-loaded cleaning elements 40, may extend at angles different relative to one another.

Figure 3A:
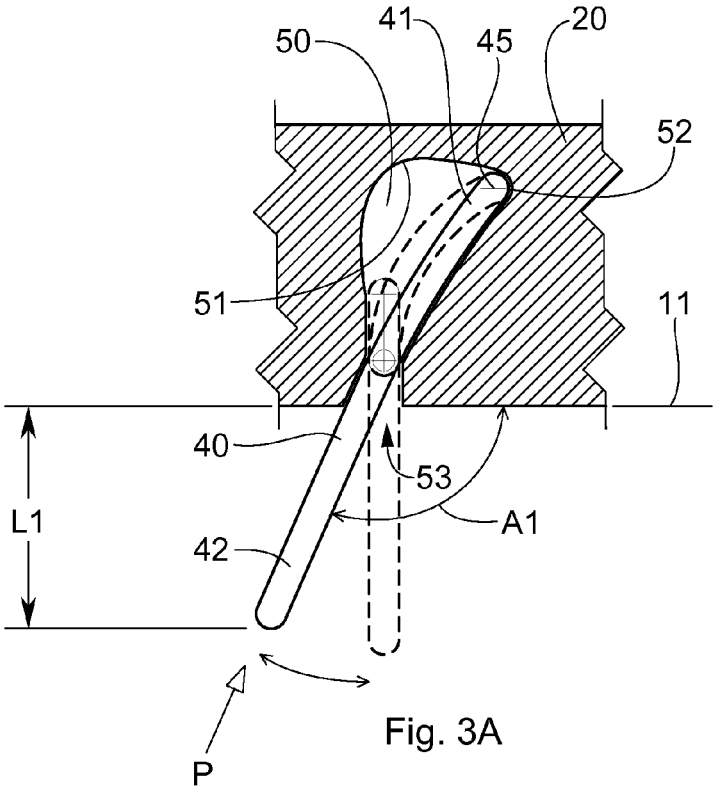
FIGS. 3A and 3B schematically show fragmental cross-sectional views of the oral-care implement having a spring-loaded cleaning element in two extreme positions, wherein an angle of projection and a length of a projecting portion of the spring-loaded cleaning element changes.

The individual spring-loaded cleaning element 40 may comprise a single monofilament or a tuft, as is well known in the art. The individual spring-loaded cleaning element 40 comprises a spring portion 41 disposed in the channel 50 and a projecting portion 42 longitudinally adjacent to the spring portion 41 and outwardly extending from the channel 50 at an angle of projection A1 relative to the bristle carrier 20, FIG. 3A. When pressure P is applied during use of the oral-care implement 10 (e.g., brushing), the spring portion 41 elastically deforms (buckles or bends) inside the channel 50 to at least partially conform to a shape of the channel 50, FIGS. 3A and 3B. This causes the projecting portion 42 to change its length, from L1 to L2, as well as the angle of projection at which the spring-loaded cleaning element 40 projects from the bristle carrier 20, from A1 to A2, FIGS. 3A and 3B. The channel 50 may comprise a curved portion 51 suitably shaped to facilitate the elastic deformation of the spring portion 41 of the spring-loaded cleaning element 40 inside the channel 50.

In one embodiment, the channel includes a closed end 52. In other words, the channel 50 can be structured to be a "blind" channel. The end 52 can support an embedded end 45 of the spring portion 41 disposed in the channel 50. An open mouth 53, disposed opposite to the closed end 52, can be structured to facilitate a movement of the spring-loaded cleaning element 40 therethrough when the spring portion 41 elastically deforms inside the channel 50.

The open mouth 53 can also be structured to cause the spring-loaded cleaning element 40 to form a desired angle of projection A when the spring portion 41 elastically deforms inside the channel 50. Thus, the open mouth 53 can be configured to allow a movement of the spring-loaded cleaning element 40 through the open mouth 53 resulting in a change of the angle of projection of the projecting portion 42 of the spring-loaded cleaning element 40, FIGS. 3A, 3B.

In other embodiments (not shown) the channel 50 can be open from both ends, to facilitate removal of water, dentifrice, particles, and the like from the oral-care implement 10. In such an embodiment, the embedded end 45 can be supported inside the channel 50 by other means, such as, e.g., mechanically or adhesively.

Figure 3B:
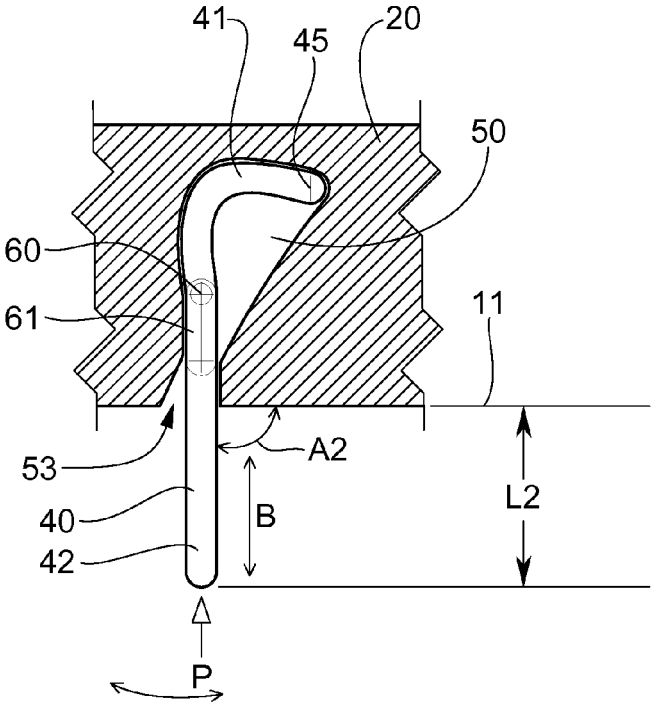

In some embodiments, the oral-care implement 10 may comprise a shaft 60 connected to the spring-loaded cleaning element 40. In such embodiments, the channel 50 may include a travel path 61 structured to receive the shaft 60 for movement along the travel path 61, FIG. 3B. The shaft 60 can be connected to the spring-loaded cleaning element 40, i.e., intermediate its embedded end and its free end, FIG. 3B. In use, a movement of the shaft 60 along the travel path 61 facilitates elastic deformation of the spring-loaded cleaning element 40 inside the channel. The travel path 61 can be suitably sized and configured to allow the shaft 60 to move back and forth (up and down in FIG. 3B) under the influence of pressure P periodically applied to the spring-loaded cleaning element 60 during use of the oral-care implement. The force P forces the shaft 60 to move inside the channel 50 along the travel path 61, thereby forcing the spring portion 41 to deform inside the channel 50. As is best shown in FIG. 3B, the elastic deformation of the spring portion 41 inside the channel 50 can occur in accordance with a predetermined pattern based on the shape of the curved portion of the channel 50.

In embodiments in which the oral-care implement 10 comprises a plurality of spring-loaded cleaning elements embedded in and outwardly extending from the bristle-carrier 20, each of the spring-loaded cleaning elements 40 can be disposed in its respective channel 50 formed in the bristle carrier 20. Each of the spring-loaded cleaning elements 40 can be structured and configured to elastically deform inside the channel 50, wherein angles of projection at which individual spring-loaded cleaning elements 40 outwardly extend from the bristle carrier 20 change, either uniformly or non-uniformly, as the spring-loaded cleaning elements 40 elastically deform inside their respective channels 50.

Figure 4:
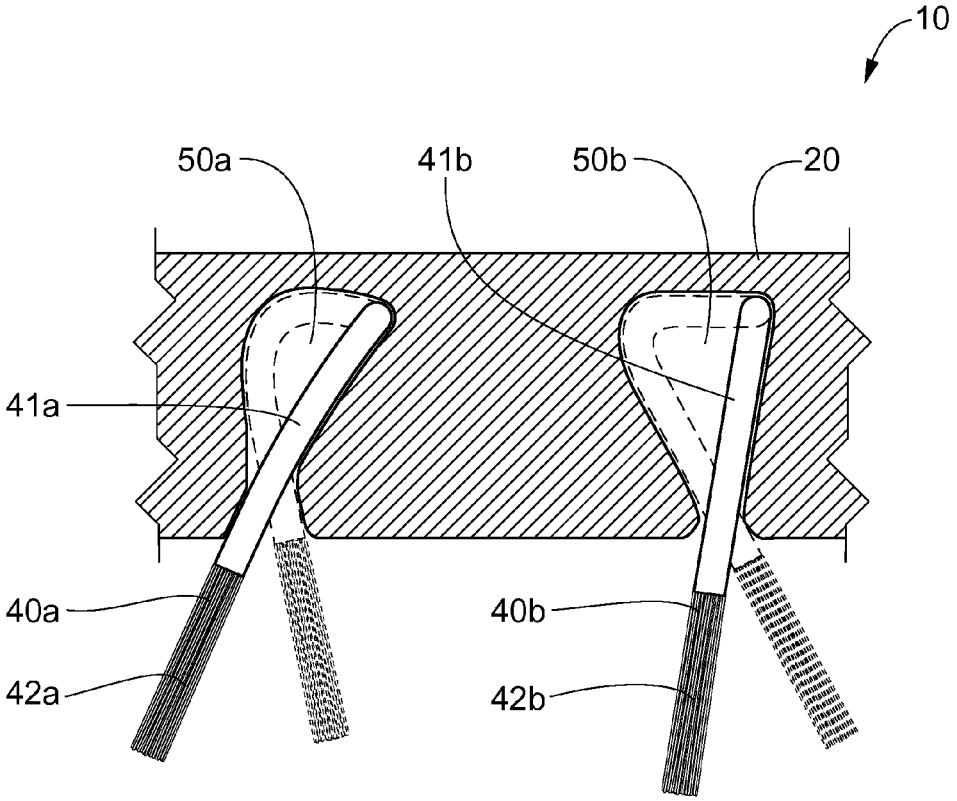
FIG. 4 schematically shows a cross-sectional view of an embodiment of the oral-care implement having spring-loaded cleaning elements disposed in channels having differential shapes.

In a further embodiment, the angles of projection, at which the individual spring-loaded cleaning elements 40 outwardly extend from the bristle carrier 20, may differ from one another, FIG. 4. In another embodiment, the angles of projection may change non-uniformly relative to one another, FIG. 4. Such a non-uniform change of the angles of projection can be caused or influenced, e.g., by differential shapes of the channels 50. The differential shapes of the channels can cause differential elastic deformation of the spring-loaded cleaning elements 40.

In FIG. 4, e.g., an embodiment of the oral-care implement 10 comprises a first channel 50*a* and a second channel 50*b*, wherein the first channel 50*a* has a first shape and the second channel 50*b* has a second shape different from the first shape. A first spring-loaded cleaning element 40*a* is disposed in the first channel 50*a*, and a second spring-loaded cleaning element 40*b* is disposed in the second channel 50*b*. The first channel 50*a* is configured to facilitate a first elastic deformation of the first spring-loaded cleaning element 40*a*, and the second channel 50*b* is configured to facilitate a second elastic deformation of the second spring-loaded cleaning element 40*b*. Since under pressure the spring portions 41*a*, 41*b* of the respective first and second spring-loaded cleaning elements 40*a*, 40*b* tend to at least partially conform to the shape of their respective channels 50*a*, 50*b*, the first elastic deformation will be different from the second elastic deformation. This will result in the change of the angle of projection of the first spring-loaded cleaning element 40*a* being different from the change of the angle of projection of the second spring-loaded cleaning element 40*b*, FIG. 4.

In other embodiments, non-uniform changes of the angles of projection can be caused, e.g., by differential shapes and/or sizes of the travel path 61 (not shown). In still other embodiments, non-uniform changes of the angles of projection can be caused or influenced by variations in physical characteristic of the individual spring-loaded cleaning elements 40. These physical characteristics may include, e.g., the cleaning elements' length, thickness, geometry, cross-sectional shape, area moment of inertia, stiffness, elasticity, surface energy, chemical composition, color, and the other relevant characteristics.

In several illustrations of the invention, the spring-loaded cleaning elements 40 are schematically depicted as comprising generally solid elastomer bodies, shaped and arranged for optimal cleaning. Examples of suitable elastomer bodies and their configurations can be found, e.g., in U.S. Pat. No. 6,553,604; U.S. Pat. No. 6,151,745; U.S. Pat. No. 5,987,688; U.S. Patent Application Publications No. 2004/0177462 filed on Mar. 14, 2003 and U.S. Patent Application Publications No. 2005/0235439 filed on Apr. 23, 2004.

In other embodiments, the spring-loaded cleaning elements 40 are schematically depicted as including a plurality of bristles, forming a tuft, FIG. 4. In further embodiments of the oral-care implement, the spring-loaded cleaning elements 40 may comprise both the spring-loaded cleaning elements 40 made of solid elastomer bodies and the spring-loaded cleaning elements 40 comprising a plurality of bristles forming a tuft. In other embodiments, the individual spring-loaded element 40 may comprise a spring portion 41 formed by a solid elastomer or other material, and the projecting portion 42 comprising a plurality of bristles forming a tuft and longitudinally connected to the solid spring portion 41, FIG. 4. Embodiments comprising a reversed implementation of the individual spring-loaded cleaning element 40 are contemplated as well.

The spring-loaded cleaning element 40 may comprise a uniform structure or composition, wherein both the spring portion 41 and the projecting portion 42 comprise an essentially identical material. In another embodiment, the spring-loaded cleaning element 40 may comprise a composite structure, wherein the spring portion 41 comprises a first element and the projecting portion 42 comprises a second element, FIGS. 4 and 4A. In such an embodiment, the spring portion 41 can be longitudinally attached to the projecting portion 42 by any means known in the art, e.g., overmolding of the filaments in the tuft, gluing and welding, e.g., laser-welding, or by manufacturing the spring portion 41 and the projecting portion 42 in a multicomponent molding process. In one particular embodiment, the spring portion 41 can be attached to the projecting portion 42 by the shaft 60, FIG. 3B.

Non-limiting examples of the composite spring-loaded cleaning element 40 include those in which the spring portion 41 and the projecting portion 42 comprise the following combinations:

| Spring Portion | Projecting Portion |
|---|---|
| PA (polyamide) | PA, TPE (thermoplastic elastomer) |
| PP (polypropylene) | TPE |
| POM (polyoxymethylene) | TPE, PA |
| TPE | TPE, PA |
| ABS (acrylonitrile butadiene styrene) | TPE |

Embodiments are contemplated where the spring-loaded cleaning elements 40 comprise elastomeric elements commonly known as "fins," such as those, e.g., disclosed in U.S. Pat. No. 6,553,604 or U.S. Patent Application Publication No. 2005/0235439. The fins may comprise either one or both of the spring portion 41 and the projecting portion 42 of the spring-loaded cleaning element 40—and may be structured to be fitted into the channels 50 or attached, e.g., mechanically or adhesively, to the spring portion 41.

In an exemplary embodiment of FIG. 4, e.g., each of the shown spring-loaded cleaning elements 40*a* and 40*b* comprises the spring portion 41*a*, 41*b* that is solid and the projecting portion 42*a*, 42*b* that comprises a plurality of conventional bristles forming a tuft. Likewise, in another exemplary embodiment shown in FIG. 4A, a spring-loaded cleaning element 40*c* comprises a spring portion 41*c* that is formed by a solid-mass material and a projecting portion 42*c* that comprises a tuft formed by a plurality of individual bristles.

Figure 4A:
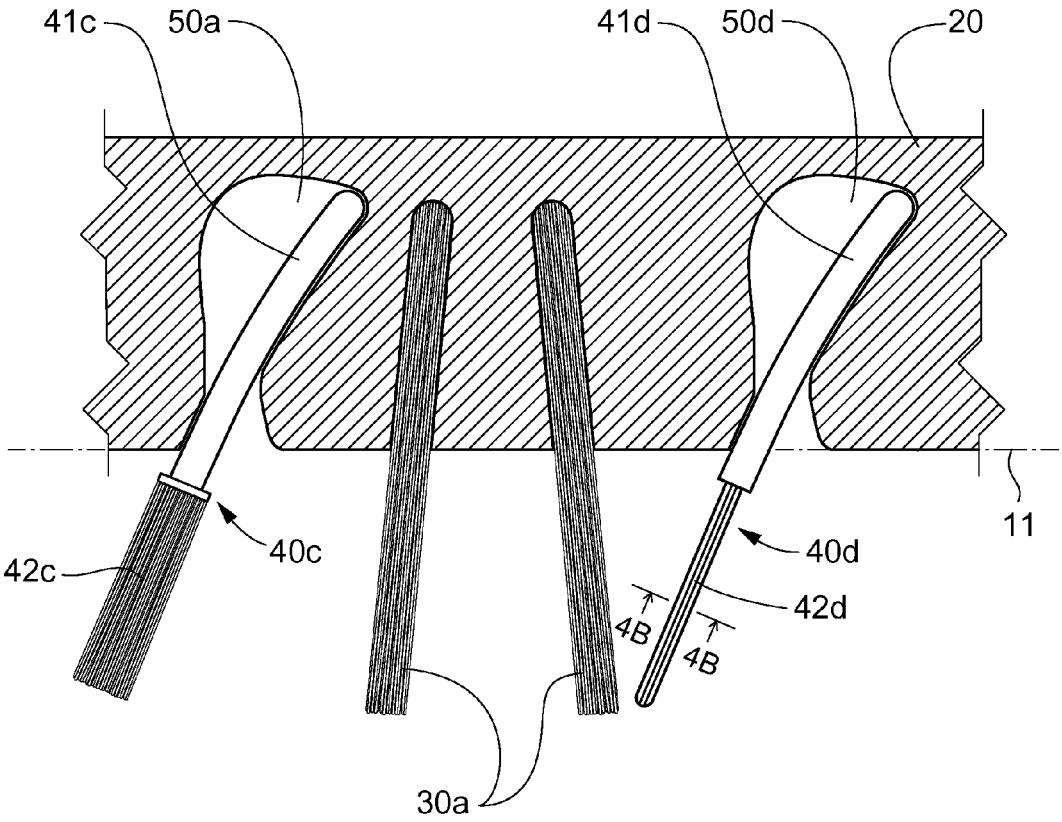
FIG. 4A schematically shows a cross-sectional view of another embodiment of the oral-care implement having conventional cleaning elements and spring-loaded cleaning elements.
Figure 4B:
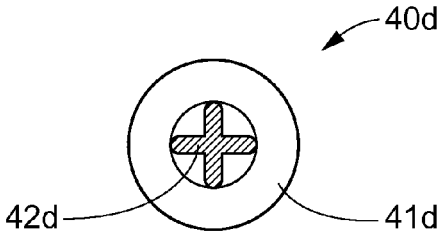
FIG. 4B is a cross-sectional view taken along B-B in FIG. 4A.

The embodiment shown in FIG. 4A also includes a spring-loaded cleaning element 40*d* that comprises a spring portion 41*d* and a projecting portion 42*d*, wherein the spring portion 41*d* differs from the projecting portion 42*d* in at least one physical characteristic selected from the group consisting of length, thickness, geometry, cross-sectional shape, area moment of inertia, stiffness, elasticity, surface energy, chemical composition, color, and any combination thereof. As is best shown in the cross-sectional view of FIG. 4B, the spring portion 41*d* has an overall diameter that is greater than that of the projecting portion 42*d*. In addition, the spring portion 41*d* has an X-shaped cross-section, whereas the projecting portion 42*d* has a generally round cross-section. One skilled in the art will appreciate that various combinations of the shapes can be suitable, all of which are included in the scope of the present disclosure. In the exemplary embodiment of FIG. 4A, there are shown at least two conventional tufts 30*a*, each comprising a plurality of individual bristles. These tufts 30*a* are shown as having different inclination angle relative to the longitudinal axis 11 of the implement.

In the exemplary embodiment of the oral-care implement shown in FIG. 4A, the spring portion 41*c* of the spring-loaded cleaning element 40*c* may differ from a corresponding spring portion 41*d* of the spring-loaded cleaning element 40*d* in at least one physical characteristic selected from the group consisting of length, thickness, geometry, cross-sectional shape, area moment of inertia, stiffness, elasticity, surface energy, chemical composition, color, and any combination thereof. Likewise, the projecting portion 42*c* of the spring-loaded cleaning element 40*c* may differ from a corresponding projecting portion 42*d* of the spring-loaded cleaning element 40*d* in at least one physical characteristic selected from the group consisting of length, thickness, geometry, cross-sectional shape, area moment of inertia, stiffness, elasticity, surface energy, chemical composition, color, and any combination thereof.

Figure 5:
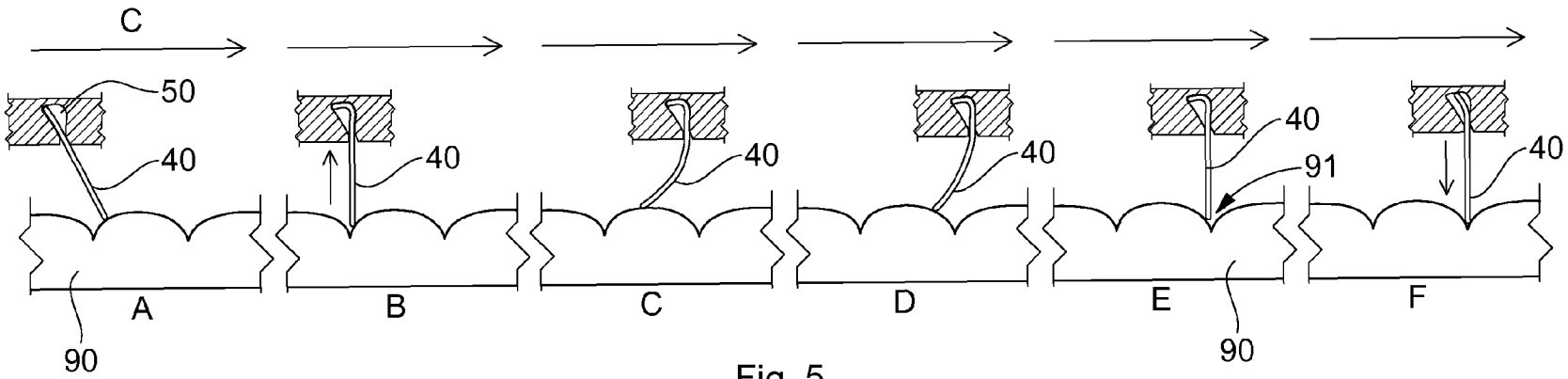
FIG. 5 schematically shows elastic deformation of the spring-loaded cleaning element during its use.

Not wishing to be bound by a theory, the inventors believe that FIG. 5 schematically shows a movement, in a direction of an arrow C and relative to the user's teeth 90, of the oral-care implement of the disclosure, comprising the spring-loaded cleaning element 40. In a step A, the free end of the spring-loaded cleaning element 40 contacts the surface of the toot. In step B, the movement of the oral-care implement and the teeth's topography causes the spring portion of the spring-loaded cleaning element 40 to flex, or elastically deform, inside the channel 50, as is described herein. In steps C and D, as the oral-care implement travels further relative to the teeth, the projecting portion of the spring-loaded cleaning element may also elastically deform as its free end scratches the surface of the tooth, whereas the contact with the tooth is maintained. In steps E and D, during further movement, upon reaching an interdental gap 91, the spring-loaded cleaning element 40 suddenly releases its energy accumulated during its elastic deformation.

In other words, the spring-loaded element 40 is structured and configured to dynamically "kick" into the interdental gap 91. This will facilitate a more efficient interruption of a plaque layer existing on the surface of the teeth, and particularly in the otherwise hard-to-reach interdental gap. This will also allow the cleaning elements to achieve a deeper penetration between the teeth. In addition, it is hypothesized that the ability of the spring-loaded cleaning element to flex inside the channel will beneficially result in an increased contact time between the free end, or tip, of the spring-loaded element and the surface of the teeth, relative to that of conventional (stationary) cleaning elements. The ability of the spring-loaded cleaning elements to flex inside the channels, thereby changing their projected lengths and angles of projection, will also facilitate the spring-loaded cleaning elements' adaptability to the individual topography of the user's mouth and teeth, thereby promoting a more comfortable feeling by the user during brushing, including increased comfort with respect to the user's gums.

The brushing forces on a toothbrush during brushing can be in a range between about 0.5 N and about 10 N dynamically—and typically between about 2 N and about 4 N, considering the entire brush. An individual filament or tuft carries only a portion of the complete brush force. The buckling of the individual spring-loaded cleaning element 40 occurs within the range of the typical brushing forces, preferably up to 2 N, to avoid the risk of damage to the user's gums. The buckling force of an individual spring-loaded cleaning element 40 can be in the range of from about 0.01 N to about 2 N. Depending on the material properties (e.g., influencing young modulus) and the shape of the cross-sectional area of the spring-loaded cleaning element 41 (e.g., influencing moment of inertia) the dimensions of the spring-loaded cleaning element 41 can be defined to achieve the desired buckling force requirement.

For a round-shaped element, the buckling force can be defined in the following manner:

$$F_k = \frac{\pi^2 EI}{s^2},$$

where

"E" is a young modulus; "I" is a moment of inertia, wherein $I=\pi/4+R^4$; and "s" is a length. As the length of the cleaning element is typically relatively short in the brush head and the cross-sectional area is defined, among other things, by available space in the brush head, the suitable material can be chosen to fulfill the requirement of the buckling force to be greater than 0.01 N, or $F_k<(0.01-2.0)$N.

For example, a spring element having a length of about 4 mm, a young modulus E of about 3400 MPa, and a diameter d of about 0.25 mm would require roughly 0.4 N to buckle. Softer materials may be chosen for thicker elements to keep the buckling forces low. In order to keep the pressure on the soft tissues in a desired range, the respective diameters of the spring portion 41 and of the projecting portion 42 may be different. For example, low pressure on the user's gums by the spring-loaded cleaning element 40 can be achieved by having a larger cross-sectional area of the projecting portion 42 relative to the cross-sectional area of the spring portion 41.

Figure 6A:
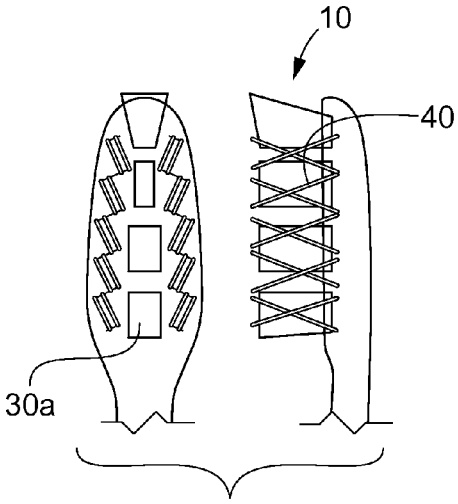
FIGS. 6A-6E schematically show, in plan and side views, several non-limiting embodiments of the oral-care implement having different exemplary patterns of the spring-loaded cleaning elements thereon.
Figure 6B:
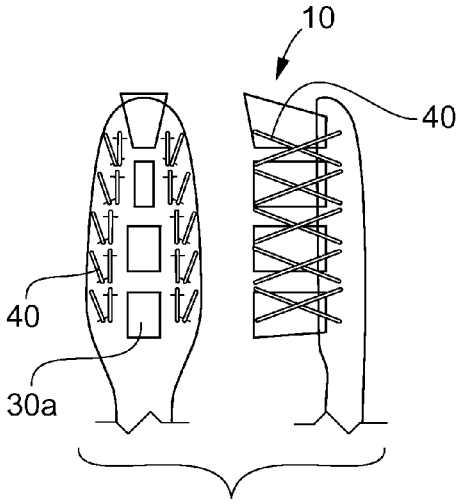
Figure 6C:
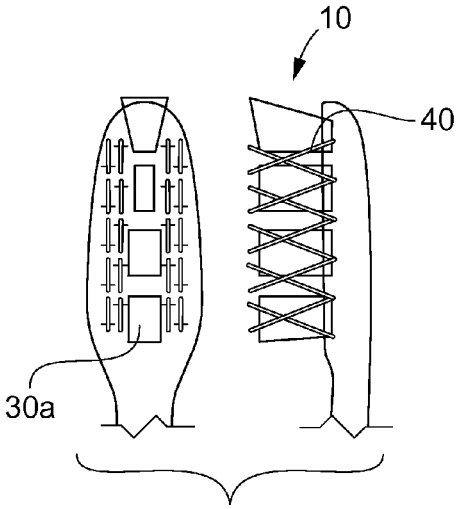
Figure 6D:
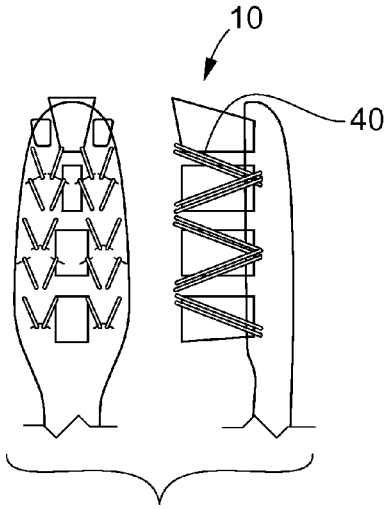
Figure 6E:
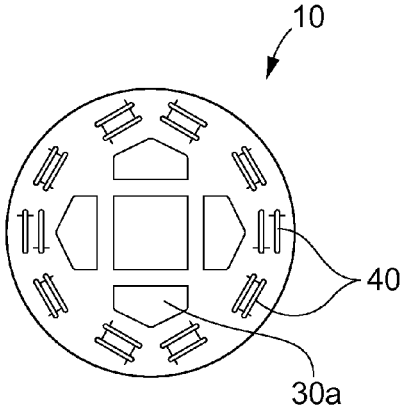

Several exemplary patterns of the spring-loaded cleaning elements 40, and conventional stationary elements 30*a*, are shown in FIGS. 6A-6E. FIGS. 6A-6D schematically illustrate the oral-care implement 10 comprising a manual toothbrush. FIG. 6E schematically illustrates, in plan view, the oral-care implement 10 comprising a refill for an electric toothbrush. One skilled in the art will recognize that many other suitable configurations and combinations of patterns can be had. All of these patterns and combinations are included in the scope of the present disclosure.

The disclosure of every document cited herein, including any cross-referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein—or that it alone, or in any combination with any other reference or references, teaches, suggests, or discloses any such invention. Further, to the extent that any meaning or definition of a term in this document conflicts with any meaning or definition of the same or similar term in a document incorporated by reference, the meaning or definition assigned to that term in this document shall govern.

While particular embodiments have been illustrated and described herein, various other changes and modifications may be made without departing from the spirit and scope of the invention. Moreover, although various aspects of the invention have been described herein, such aspects need not be utilized in combination. It is therefore intended to cover in the appended claims all such changes and modifications that are within the scope of the invention.

What is claimed is:

1. An oral-care implement having a longitudinal axis and comprising a bristle carrier and a plurality of cleaning elements embedded in and outwardly extending from the bristle carrier, wherein at least two of the plurality of cleaning elements are a first spring-loaded cleaning element movably disposed in a first channel and a second spring-loaded cleaning element movably disposed in a second channel, the first and second channels being formed in the bristle carrier, each of the at least two spring-loaded cleaning elements comprising a spring portion disposed in one of the first and second channels and a projecting portion longitudinally adjacent to the spring portion and outwardly extending from the one of the first and second channels at an angle of projection relative to the longitudinal axis of the oral-care implement, wherein the spring portion of the first spring-loaded cleaning element is structured and configured to elastically deform inside the first channel to at least partially conform to a shape of the first channel, and the spring portion of the second spring-loaded cleaning element is structured and configured to elastically deform inside the second channel to at least partially conform to a shape of the second channel, thereby causing the projecting portions of the first and second spring-loaded cleaning elements to change their respective lengths and the angles of projection, wherein a shape of the first channel is different from a shape of the second channel.

2. The oral-care implement of claim 1, wherein the cleaning elements extend from the bristle carrier at differential angles relative to the longitudinal axis.

3. The oral-care implement of claim 1, wherein at least one of the first and second channels comprises a curved portion structured and configured to facilitate the elastic deformation of the spring portion of at least one of the spring-loaded cleaning elements inside at least one of the first and second channels.

4. The oral-care implement of claim 3, wherein the elastic deformation of the spring portion of the at least one of the spring-loaded cleaning elements inside at least one of the first and second channels occurs in accordance with a predetermined pattern at least partially based on a shape of the curved portion of the at least one of the first and second channels.

5. The oral-care implement of claim 1, wherein each of the first and second channels includes a closed end and an open mouth opposite to the closed end, wherein the closed end supports an embedded end of the spring portion disposed therein, and the open mouth facilitates a movement of at least one of the spring-loaded cleaning elements therethrough when the spring portion elastically deforms inside each of the first and second channels.

6. The oral-care implement of claim 5, wherein the movement of at least one of the spring-loaded cleaning elements through the open mouth of the at least one of the first and second channels includes a change of the angle of projection of the projecting portion of the at least one of the spring-loaded cleaning elements.

7. The oral-care implement of claim 1, further comprising a shaft connected to at least one of the spring-loaded cleaning elements, wherein the shaft is structured and configured to travel inside at least one of the first and second channels along a travel path.

8. The oral-care implement of claim 1, wherein one of the spring portion and the projecting portion of at least one of the spring-loaded cleaning elements comprises a single element and the other of the spring portion and the projecting portion of the at least one of the spring-loaded cleaning elements comprises a plurality of bristles forming a tuft.

9. The oral-care implement of claim 1, wherein one of the spring portion and the projecting portion of the first spring-loaded cleaning element differs from the other of the spring portion and the projecting portion of the second spring-loaded cleaning element in at least one physical characteristic selected from the group consisting of length, thickness, geometry, cross-sectional shape, area moment of inertia, stiffness, elasticity, surface energy, chemical composition, color, and any combination thereof.

10. The oral-care implement of claim 1, wherein the first channel is structured and configured to facilitate a first elastic deformation of the first spring-loaded cleaning element, and the second channel is structured and configured to facilitate a second elastic deformation of the second spring-loaded cleaning element, the first elastic deformation being different from the second elastic deformation, and whereby the change of the angle of projection of the first spring-loaded cleaning element is different from the change of the angle of projection of the second spring-loaded cleaning element.

11. An oral-care implement having a longitudinal axis and comprising a handle, a bristle carrier, and a plurality of spring-loaded cleaning elements embedded in and outwardly extending from the bristle carrier at angles of projection relative to the longitudinal axis, wherein each of the spring-loaded cleaning elements is disposed in a channel formed in the bristle carrier and outwardly extending from the channel through an open mouth thereof, wherein each of the spring-loaded cleaning elements is structured and configured to elastically deform in the channel, wherein at least some of the angles of projection change as at least some of the spring-loaded cleaning elements elastically deform inside their respective channels, and wherein the oral-care implement comprises at least a first channel and a second channel, the first channel having a first spring-loaded cleaning element therein and the second channel having a second spring-loaded cleaning element therein, wherein a shape of the first channel is different from a shape of the second channel.

12. The oral-care implement of claim 11, wherein at least some of the angles of projection differ from one another.

13. The oral-care implement of claim 11, wherein the angles of projection change non-uniformly with respect to the individual spring-loaded cleaning elements when the at least some of the spring-loaded cleaning elements elastically deform inside their respective channels.

14. The oral-care implement of claim 11, wherein each of the spring-loaded cleaning elements comprises a spring portion and a projecting portion longitudinally adjacent to the spring portion, the spring portion being disposed in the channel of the bristle carrier and terminating with an embedded end thereof, and the projecting portion outwardly extending from said channel through an open mouth of the channel and terminating with a free end, wherein the spring portion elastically deforms inside the channel when the oral-care implement is in use, thereby causing the second portion to change its length and angle of projection.

15. The oral-care implement of claim 14, wherein each of the channels includes a travel path disposed therein to receive a shaft for movement along the travel path, the shaft being connected to the spring-loaded cleaning element, wherein a movement of the shaft along the travel path facilitates elastic deformation of the spring-loaded cleaning element inside the channel according to a predetermined pattern.

16. The oral-care implement of claim 14, wherein at least one of the spring portion and the projecting portion of the first spring-loaded cleaning element differs from a corresponding portion of the second spring-loaded cleaning element in at least one physical characteristic selected from the group consisting of length, thickness, geometry, cross-sectional shape, area moment of inertia, stiffness, elasticity, surface energy, chemical composition, color, and any combination thereof.

17. The oral-care implement of claim 11, wherein the first channel is structured and configured to facilitate a first elastic deformation of the first spring-loaded cleaning element, and the second channel is structured and configured to facilitate a second elastic deformation of the second spring-loaded cleaning element, the first elastic deformation being different from the second elastic deformation, and whereby the change of the angle of projection of the first spring-loaded cleaning element is different from the change of the angle of projection of the second spring-loaded cleaning element.

* * * * *